US005743428A

United States Patent [19]

Rankin, VI

[11] Patent Number: 5,743,428

[45] Date of Patent: Apr. 28, 1998

[54] PRINTED SPRINGS AND METHOD OF MANUFACTURE

[75] Inventor: Alexander Rankin, VI, Dresher, Pa.

[73] Assignee: Vulcan Spring & Mfg. Co., Telford, Pa.

[21] Appl. No.: 795,869

[22] Filed: Feb. 6, 1997

Related U.S. Application Data

[62] Division of Ser. No. 496,193, Jun. 28, 1995, Pat. No. 5,649,363.

[51] Int. Cl.[6] ..... G07F 11/00

[52] U.S. Cl. ..... 221/6; 211/59.3

[58] Field of Search ..... 221/4, 5, 6, 8, 221/279, 271; 312/71

[56] References Cited

U.S. PATENT DOCUMENTS

| | | | |
|---|---|---|---|
| 2,425,553 | 8/1947 | Musselman et al. | 312/47 |
| 2,546,352 | 3/1951 | Weaver | 221/6 |
| 3,205,583 | 9/1965 | Purbaugh | 33/137 |
| 4,106,668 | 8/1978 | Gebhardt et al. | 221/131 |
| 4,742,936 | 5/1988 | Rein | 221/5 |
| 5,011,015 | 4/1991 | Ziegler et al. | 206/387 |
| 5,012,936 | 5/1991 | Crum | 211/59.3 |
| 5,127,324 | 7/1992 | Palmatier et al. | 101/248 |
| 5,131,563 | 7/1992 | Yablans | 221/9 |
| 5,178,063 | 1/1993 | Wolfberg et al. | 101/76 |

*Primary Examiner*—Kenneth Noland
*Attorney, Agent, or Firm*—Howson and Howson

[57] ABSTRACT

A spring to operate a merchandise dispenser used for storing and dispensing a plurality of like items of merchandise. The dispenser utilizes a metal spring having indicia imprinted or engraved thereon to provide both a biasing force to the merchandise and inventory information. A method is provided for producing a metal spring having indicia printed in ink or paint.

7 Claims, 3 Drawing Sheets

PRINTED SPRINGS AND METHOD OF MANUFACTURE

This is a division of application Ser. No. 08/496,193 filed on Jun. 28, 1995 now U.S. Pat. No. 5,649,363.

FIELD OF THE INVENTION

The present invention relates to an improvement in a merchandise dispenser for storing and dispensing a plurality of like items of merchandise, and more particularly the present invention relates to the use of a metal spring both for biasing the merchandise forward and for providing inventory control indicia. The present invention also relates to a method for making metal springs having printed indicia thereon.

BACKGROUND OF THE INVENTION

It has become common practice in modern retail merchandising to provide a dispenser for both storing a quantity of like items of merchandise and dispensing the merchandise one at a time. In the dispenser, items of merchandise are aligned one behind the other and they are biased forward toward an opening which enables dispensing of the front item of merchandise. When the front item is removed, the remaining aligned items of merchandise automatically move forward such that the next item in line can be removed via the opening.

An example of a merchandise dispenser is disclosed in U.S. Pat. No. 5,131,563 issued to Yablans. The Yablans apparatus can be used to store and dispense merchandise such as lipstick.

A problem with known merchandise dispensers is that the quantity of merchandise contained within the dispenser is not easily determinable. The structure of the dispensers, and how the dispensers are installed, do not allow for ready visual observation of the stored merchandise.

U.S. Pat. No. 4,742,936 issued to Rein addresses the problem of indicating the quantity of merchandise remaining in the dispenser. The Rein dispenser utilizes a bias mechanism to bias the aligned quantity of merchandize forward. In one embodiment, the bias mechanism is a coiled spring, and in a second embodiment, the dispenser is mounted at an angle steep enough so that the force of gravity biases the merchandise forward. Separate and apart from the bias mechanism, the Rein dispenser utilizes a numerically embossed self coiling plastic sheet. The embossed numerals correspond to the quantity of merchandise remaining in the dispenser. The bias mechanism provides the driving force to move the articles to be dispensed.

Although the aforementioned merchandise dispensers function satisfactorily for their intended purposes, there is a need for an improved merchandise dispenser having a single means for not only biasing the merchandise forward but also for indicating the inventory contained in the dispenser. The biasing and inventory means should be capable of being produced inexpensively in commercial quantities to minimize the overall cost of manufacturing a commercially-desirable merchandise dispenser.

OBJECTS OF THE INVENTION

With the foregoing in mind, a primary object of the present invention is to provide an improved merchandise dispenser having a common means for inventory indication and motivation.

Another object of the present invention is to provide a metal spring capable of providing both a bias function and an inventory function for use in a merchandise dispenser.

A further object of the present invention is to provide novel methods for the production of indicia-imprinted metal springs.

SUMMARY OF THE INVENTION

More specifically, the present invention provides an improvement for a merchandise dispenser used in storing and dispensing a plurality of like items of merchandise. The dispenser has at least one opening to allow a front one of the merchandise items to be dispensed. The remaining merchandise items are aligned behind the front merchandise item within the dispenser and are biased forward toward the opening.

The improvement comprises a metal spring which provides the driving force to bias the merchandise forward and which has indicia printed thereon at spaced intervals to provide inventory information concerning the number of items of merchandise stored in the dispenser.

The present invention also provides a method for making metal springs having printing thereon. The method comprises feeding a continuous strip of metal past a printing station having a print head. The print head prints indicia at pre-set intervals on the uncoiled metal as it advances past the print station. The advancement of the continuous supply of metal is monitored and relayed to the print head in order for the indicia to be accurately placed.

A coil memory is imparted into the metal as it continuously advances past a coiling mechanism. The continuous supply of metal is then cut, pierced and/or formed at appropriate lengths to provide individual metal springs having printing thereon.

The method preferably also includes further steps to clean the metal before printing, and also to dry the ink after printing.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENTS

Figure 1:
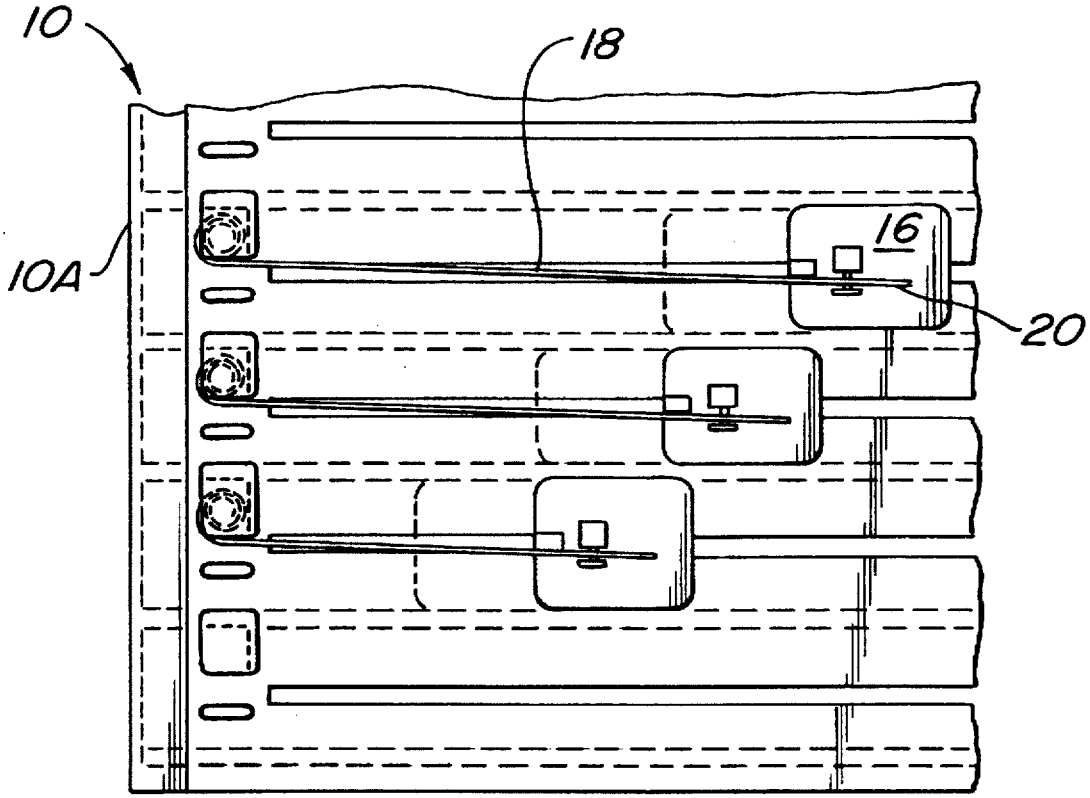
FIG. 1 is a plan view of a portion of a merchandise dispenser having improvements made according to the present invention.
Figure 2:
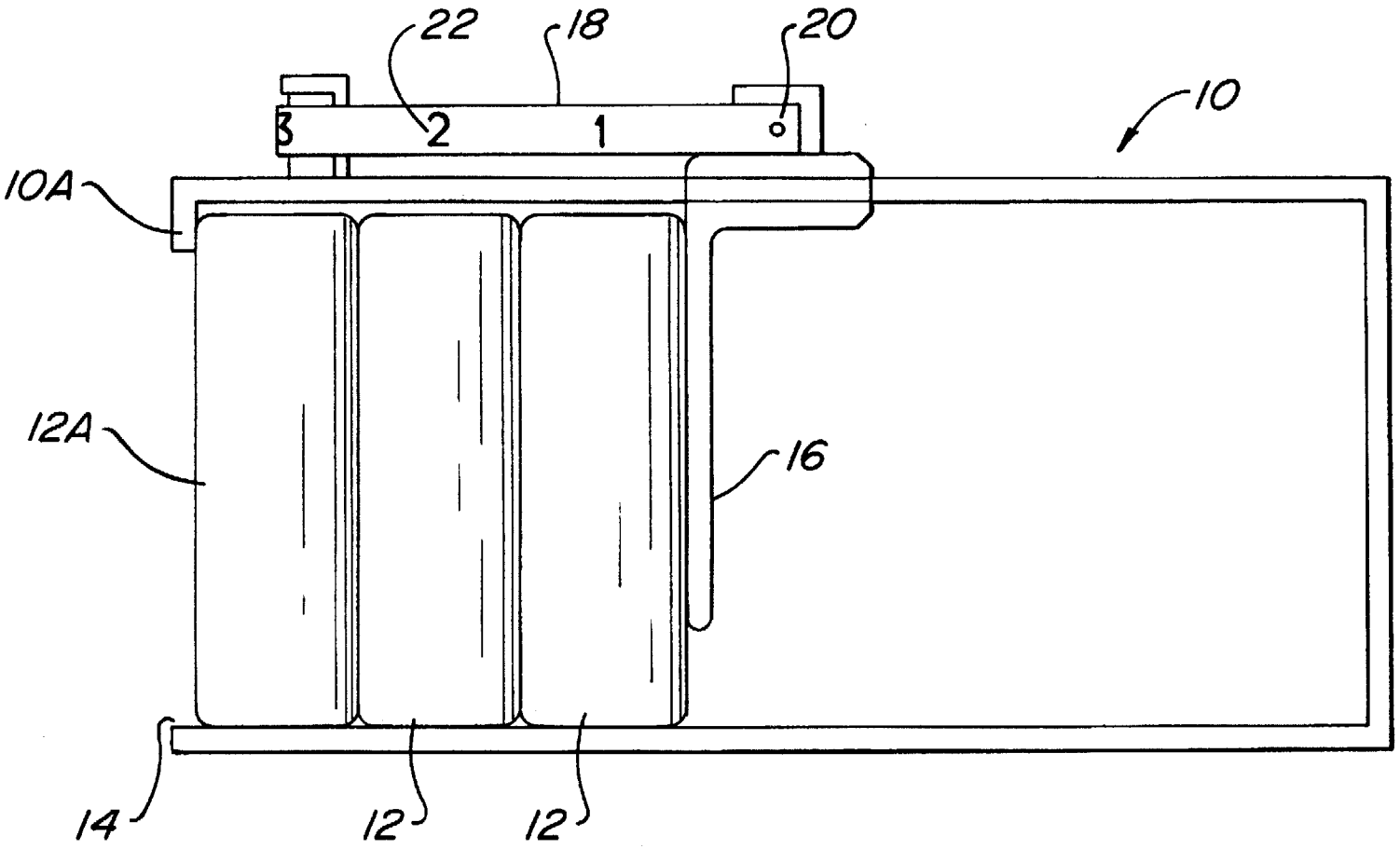
FIG. 2 is an elevational cross-sectional view of a merchandise dispenser.
Figure 4:
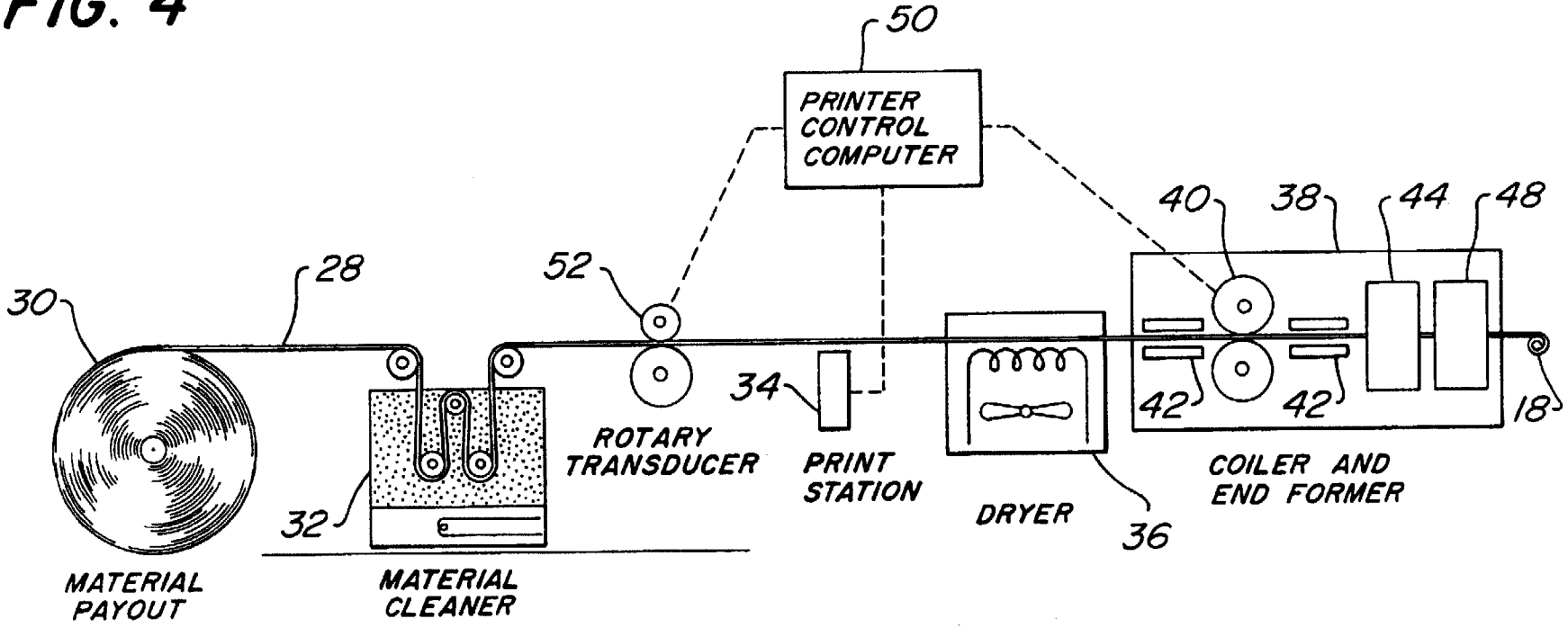
FIG. 4 is a schematic view of a process line for producing printed metal springs according to the present invention.

Referring now to the drawings, FIGS. 1 and 2 illustrate a merchandise dispenser 10 for storing and dispensing a plurality of like items of merchandise 12. The dispenser 10 can be made of plastic, metal, wire, wood or other suitable materials, and is used to store and dispense articles of merchandise 12 such as cigarettes, cosmetics, etc. The merchandise items 12 are aligned one behind the other with a front one 12A adjacent an opening 14 at the front 10A of the dispenser 10. When the front item 12A is removed through the opening 14, the remaining aligned merchandise items 12 all move forward such that the next in line takes a position adjacent the opening 14.

To bias the aligned merchandise items 12 forward, a moveable follower 16 abuts the rearwardly most one of the aligned merchandise items. A biasing mechanism connects to the moveable follower 16 to provide a driving force in a forward direction relative to the dispenser. Therefore, as the front merchandise 12A is removed through the opening 14, the follower 16 is forced forward moving the aligned merchandise toward the opening 14.

The biasing mechanism of the present invention utilizes a metal spring 18. As best seen in FIG. 1, one end 20 of the spring is connected to the moveable follower 16. The other end of the spring is connected to the dispenser 10 near the opening 14. When the dispenser 10 is full with merchandise, the spring 18 is stretched out into its maximum elongated position. As the merchandise items 12 are removed one by one, the spring 18 forces the moveable follower 16, as well as the remaining aligned merchandise, forward. As each article of merchandise is removed, the spring 18 continues to coil until finally all merchandise items are removed and the follower 16 is adjacent the opening 14 of the dispenser 10. At this point, the spring 18 is at its maximum coiled condition.

Since the articles 12 are aligned one behind the other and fully contained within the dispensing apparatus, it is not possible to view all the merchandise to determine how many remain within the dispenser 10. As recited earlier, the Rein patent overcame this problem by adding an additional item to the dispenser solely for providing inventory indication. It is the goal of the present invention to eliminate this extra part from the dispenser to reduce the cost of manufacturing the dispenser and to reduce maintenance problems.

Figure 3:
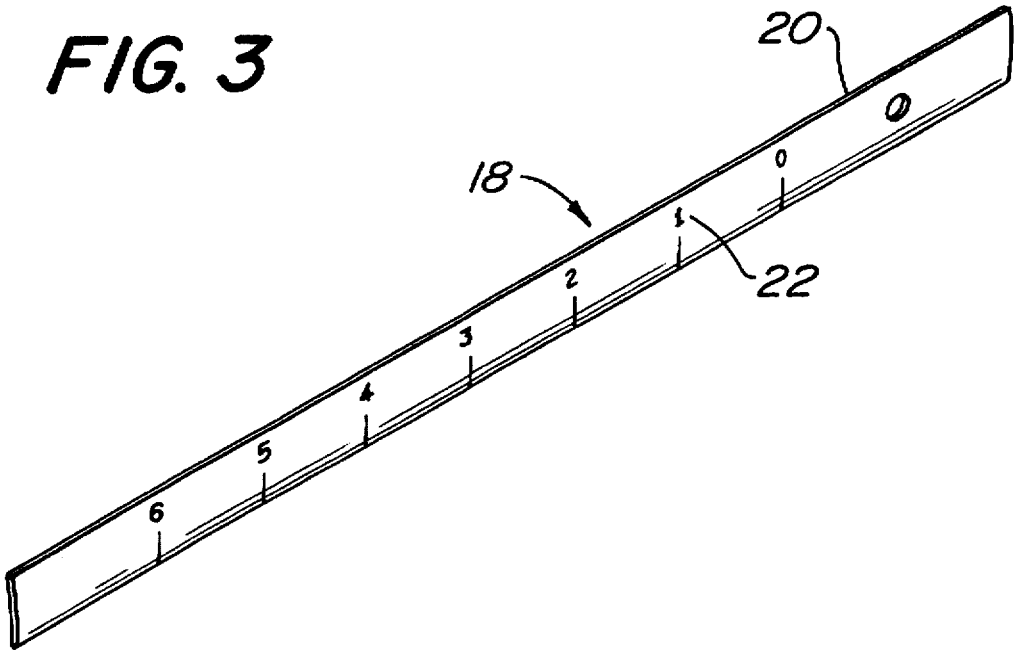
FIG. 3 is a perspective view of a portion of a printed metal spring made according to the present invention.

To this end, the present invention provides a metal spring 18 having printing or engraving thereon which corresponds to the quantity of merchandise remaining in the dispenser 10. For instance, as shown in FIG. 3, the spring 18 can have indicia 22 such as numerals, letters, etc. printed at pre-set intervals so that as the articles are removed from the dispenser 10 and the spring 18 coils, the indicia facing forward adjacent the opening 14 on the metal spring 18 will relate to the quantity of merchandise 12 remaining within the dispenser 10. Therefore, as shown in FIG. 2, if there are three articles of merchandise 12 in the dispenser 10, and the front one 12A is removed, the metal spring will coil, and when it comes to a stop a numeral "2" will face toward the front 10A of the dispenser 10 so that a user can visually observe that there are two articles of merchandise 12 remaining in the dispenser 10. The indicia may even be of the type that is machine readable, such as a bar-code.

There are many modifications which can be made to the above-described apparatus. For example, a viewing window (not shown) could be added at the front 10A of the dispenser 10 to frame the inventory indicia 22. The dispenser 10 could consist of a single row of merchandise, rather than the plurality as illustrated in FIG. 1. The indicia could be engraved into the spring, for instance, by a laser engraving device.

DETAILED DESCRIPTION OF THE PREFERRED METHOD

There are many problems associated with producing commercial size quantities of metal springs having indica thereon. For instance, imprinting of the indicia on the metal spring must be inexpensive so as not to increase the overall price of the dispenser. This can be done before coiling into a spring, afterward or in a separate operation. If done in a separate operation, additional processing steps are involved.

The method of the present invention applies the indicia on the metal spring before or after the metal has been imparted with a coil memory. When the metal is printed with an ink prior to coiling, the metal must proceed through the remaining part of the coiling process without the ink's being rubbed off during the process. In addition, the printed indicia must not rub off when used in a merchandise dispenser.

One embodiment of the present invention provides a method in which ink can be printed on the metal such that the ink will not rub off either in production or in normal use. Another embodiment involves engraving the indicia into the metal.

To this end, a supply reel 30 of coiled metal strip 28 is continuously fed into a cleaning apparatus 32. The cleaning apparatus 32 can be, for instance, a vapor degreaser in which any dirt or foreign matter on the metal strip is removed. This provides a clean surface onto which printing or engraving can be applied.

The clean continuous strip of uncoiled metal 28 is advanced past a print station 34 which prints or engraves indicia on the metal at pre-set intervals. The print station can be an ink-jet-type printer, a flexo-type print wheel, a laser printer, or other printers known in the art. The continuous strip of metal 28 then advances through drying apparatus 36 to insure that the printing dries on the metal before further processing. The drying apparatus 36 can be, for instance, a drying tube into which hot air is injected and exhausted. Both the cleaning and drying steps are optional.

After the printing is sufficiently dry on the metal 28, the continuous strip of uncoiled metal 28 advances through a coiler and end former 38. The coiler and end former 38 has a coiling mechanism 44 which imparts a coil memory to the continuously advancing strip of metal 28. The coiler and end former 38 contains a drive roller 40 which continuously advances the strip of metal 28.

The coiler and end former 38 has guides 42 which guide the continuous strip of metal 28 from the drying apparatus 36 to the drive roller 40, and then, from the drive roller 40 to the coiling mechanism 44. The coil mechanism can be any known apparatus for imparting a constant-force coil memory into a strip of metal.

After the continuous strip of metal 28 is imparted with a coil memory, it is then cut by cutting and punching apparatus 48 into appropriate lengths to produce a plurality of like metal springs 18 having printing thereon. Preferably, the cutting and punching apparatus 48 creates bends or holes in the spring at appropriate locations during cutting. The printing produced by this process is capable of adhering to the metal strip even though it passes through the coiling mechanism 44.

The printing of indicia on the metal must be performed accurately in order for the spring to be useful in a merchandise dispenser. For instance, when a article is removed from the dispenser, the spring should coil and come to a stop such that a number, letter or code should be facing forward so as to be viewable from the front of the dispenser.

For this purpose, the print station 34 is controlled by a computer console 50. The console 50 is supplied with information from the drive roller 40 camshaft (not shown) to determine when the continuous supply of metal 28 has advanced a predetermined distance. In addition, the computer console 50 is supplied with information from a rotary transducer 52 which provides information on how far the continuous strip of metal 28 has advanced relative to the pre-set interval. The combination of the rotary transducer 52, the camshaft of the spring coiler drive roller 40, and information supplied to the computer by the user such as, the indicia to be printed, or the intervals at which to print the indicia, provide precise and accurate printing of indicia on the continuous strip of advancing metal.

During printing of the indicia, the process must insure that errors are not compounded. For instance, if one number is slightly off line, this error should not be translated to every number printed thereafter. In order to ensure that errors are not compounded, the rotary transducer 52 is used only to supply information regarding intervals between indicia. The camshaft of the drive roller 40 provides precise information about the advancement of the continuous strip of metal and corrects any errors which may be compounded by the rotary transducer 52.

While preferred embodiments and methods of the present invention have been described in detail, various modifications, alterations, and changes may be made without departing from the spirit and scope of the invention as defined in the appended claims.

I claim:

1. In a merchandise dispenser for storing and dispensing a plurality of like items of merchandise, the dispenser having at least one opening to allow a front one of the merchandise items to be dispensed, the remaining merchandise being aligned behind the front one item within the dispenser and being biased forward toward the opening, the improvement wherein a metal spring provides a force to bias the merchandise forward, said metal spring having indicia at spaced intervals, said indicia capable of being read to provide inventory information of the merchandise stored in the dispenser.

2. A merchandise dispenser according to claim 1, wherein said indicia is engraved on said metal spring.

3. A merchandise dispenser according to claim 1, wherein said indicia is printed directly on said metal spring.

4. A merchandise dispenser according to claim 3, wherein said indicia includes a series of sequential numbers which correspond to the number of items of merchandise stored in the dispenser.

5. A merchandise dispenser according to claim 3, wherein said indicia includes a series of sequential letters which correspond to the number of items of merchandise stored in the dispenser.

6. A merchandise dispenser according to claim 3, wherein said indicia includes a series of sequential codes which correspond to the number of items of merchandise stored in the dispenser.

7. An improved metal spring for use in a merchandise dispenser for storing a plurality of like items of merchandise aligned in single file rows, the dispenser having at least one opening for dispensing a front one of the merchandise items and a moveable follower engaging the single file row, the improvement wherein said metal spring provides a force to the single file rows of merchandise via the moveable follower to bias the merchandise forward toward the opening, said metal spring having thereon inventory indicia corresponding to the number of items of merchandise remaining in one of said rows, whereby said inventory indicia can be viewed from the front to determine the quantity of merchandise remaining in the dispenser.

* * * * *